US010921097B1

(12) United States Patent
Rojas

(10) Patent No.: US 10,921,097 B1
(45) Date of Patent: Feb. 16, 2021

(54) SELF DEFENSE RING

(71) Applicant: Bernardo Rojas, Irving, TX (US)

(72) Inventor: Bernardo Rojas, Irving, TX (US)

( * ) Notice: Subject to any disclaimer, the term of this patent is extended or adjusted under 35 U.S.C. 154(b) by 0 days.

(21) Appl. No.: 16/685,465

(22) Filed: Nov. 15, 2019

(51) Int. Cl.
*F41H 9/10* (2006.01)
*A44C 9/00* (2006.01)

(52) U.S. Cl.
CPC ..... *F41H 9/10* (2013.01); *A44C 9/0053* (2013.01)

(58) Field of Classification Search
CPC ..... F41H 9/10; A44C 9/0053; B05B 7/1413; B05B 7/2402; B67D 2210/00131
USPC ..... 222/175, 78
See application file for complete search history.

(56) References Cited

U.S. PATENT DOCUMENTS 2,235,350 A * 3/1941 Anderson ..... A44C 15/002 224/148.7
4,061,249 A * 12/1977 Smith ..... A44C 9/0053 222/78
4,135,645 A 1/1979 Kimmell
5,924,601 A * 7/1999 Chen ..... F41H 9/10 222/175
6,123,228 A * 9/2000 Hippensteel ..... A44C 9/0053 222/153.11
6,126,040 A 10/2000 Hippensteel
6,135,321 A 10/2000 Hippensteel
6,540,107 B1 * 4/2003 Admony ..... A44C 9/0053 222/175
2002/0170927 A1 * 11/2002 Gerstner ..... F41H 9/10 222/175
2009/0134184 A1 * 5/2009 Stollmann ..... A44C 5/003 222/78
2010/0050690 A1 * 3/2010 Woodward ..... A44C 5/0007 63/15.1
2011/0139823 A1 * 6/2011 Staudt ..... A41D 20/00 222/175
2012/0138637 A1 * 6/2012 Ciavarella ..... A61L 2/18 222/175
2013/0320104 A1 * 12/2013 Cooper ..... A41D 19/01594 239/1

* cited by examiner

*Primary Examiner* — Benjamin R Shaw
(74) *Attorney, Agent, or Firm* — Law Office of Jeff Williams PLLC; J. Oliver Williams

(57) ABSTRACT

Embodiments of the present invention disclose a self-defense ring assembly and method for a user to deter an assailant, having a ring body, a chamber within the ring body containing a pressurized repellant, a conduit within the ring body, a nozzle located on a surface of the ring body, and a button located on the ring, the button having a portion of the conduit passing through the button such that the button selectively translates the portion of the conduit. Furthermore, the ring assembly includes a track running along the ring body, and a cover member that selectively translates along the track, the cover member selectively exposing the button.

14 Claims, 4 Drawing Sheets

SELF DEFENSE RING

BACKGROUND

1. Field of the Invention

The present application relates to wearable devices for personal protection and defense, and more particularly to rings that discharge a pressurized repellant towards an assailant when activated by the user.

2. Description of Related Art

The idea of wearable weaponry for self defense has generated a variety of inventions. One type of self defense equipment is the use of a ring containing a spray repellant. Generally, the ring is disguised as a fashion item so as not to draw attention from others as an unsightly item. To use these types of rings, the user typically activates the ring by pressing a switch that either punctures or unseals a pressurized capsule containing a repellant, where then the repellant is directed towards an assailant. However, there are several drawbacks to the known defense rings of the art. Some versions of the ring have the activation button for releasing the repellant located proximate to the head of the ring, thereby requiring the user to use a second hand not wearing the ring to activate the ring. This configuration renders the ring useless should the second hand of the user be restrained. Another version of the ring has the activation button located on the band of the ring such that the button is proximate to adjacent fingers. However, this configuration requires the user to wear the ring only on an index finger since the activation button can only be activated comfortably by a thumb digit of the hand carrying the ring, and having a ring that is exclusively an index finger ring is not always ideal for users.

Therefore, a self-defense ring having a pressurized repellant is desired that can be activated by the same hand wearing the ring as well as having an activation button located proximate to the anterior side of the hand wearing the ring.

SUMMARY OF THE INVENTION

Embodiments of the present invention disclose a self-defense ring assembly and method for a user to deter an assailant. In one embodiment of the present invention, an assembly is provided comprising: a ring body; a chamber within the ring body containing a pressurized repellant, the chamber having an opening; a conduit within the ring body, the conduit having a first end and a second end, the first end in communication with the opening; a nozzle located on a surface of the ring body, the nozzle in communication with the second end of the conduit; and a button located on the ring, the button having a portion of the conduit passing through the button, the button selectively translating the portion of the conduit. Furthermore, the ring assembly includes a track running along the ring body, and a cover member that selectively translates along the track, the cover member selectively exposing the button.

Ultimately the invention may take many embodiments. In these ways, the present invention overcomes the disadvantages inherent in the prior art.

The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions in so far as they do not depart from the spirit and scope of the present application.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
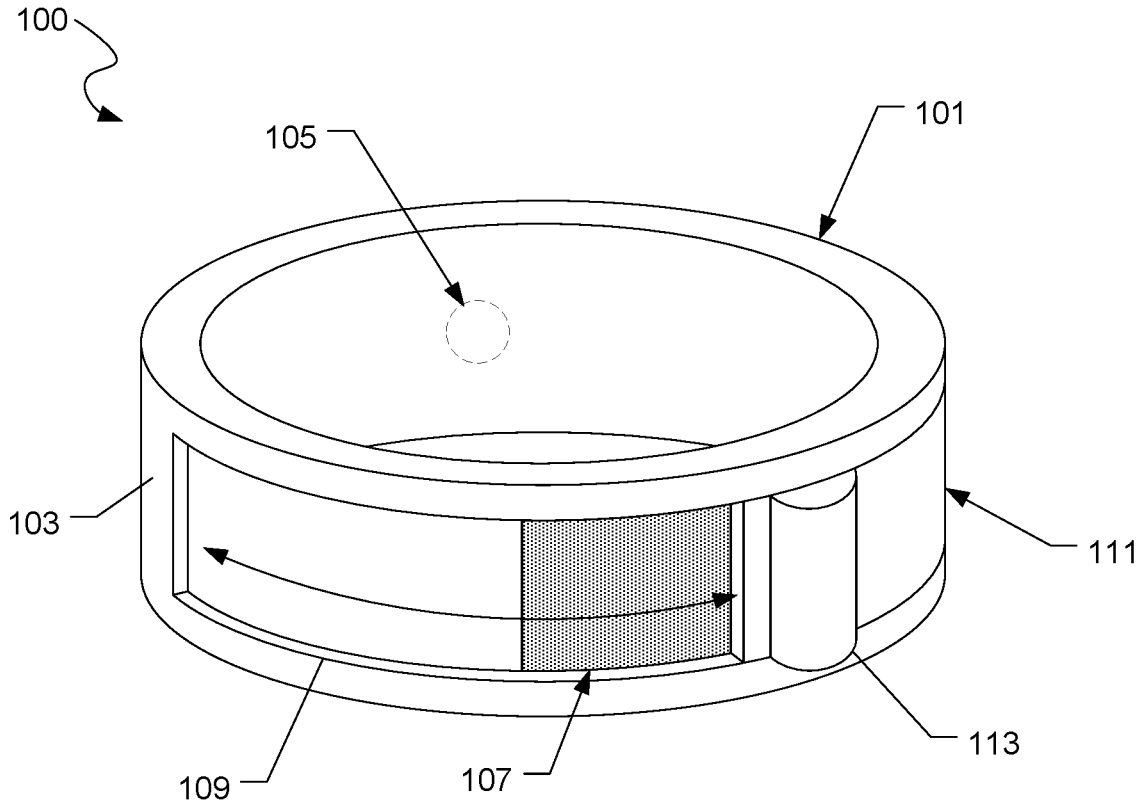
FIG. 1 is a perspective view of a self-defense ring assembly, in accordance with an embodiment of the present invention.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The assembly and method in accordance with the present invention overcomes one or more of the above-discussed problems commonly associated with self-defense rings having a pressurized repellant. In particular, system of the present invention is a self-defense ring assembly having a ring body, a chamber within the ring body containing a pressurized repellant, a conduit within the ring body that provides a passage for the pressurized repellant from the chamber to a nozzle located on a surface of the ring body, and a button having a portion of the conduit passing through the button such that the button selectively translates the portion of the conduit to interrupt the passage between the chamber and the nozzle. Furthermore, the ring assembly includes a track that runs along the ring body and a cover member that selectively translates along the track, wherein the cover member selectively exposes the button. As such, the cover member serves as a safety to prevent accidental activation of the button. These and other unique features of the system are discussed below and illustrated in the accompanying drawings.

The system will be understood from the accompanying drawings, taken in conjunction with the accompanying description. Several embodiments of the system may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The system of the present application is illustrated in the associated drawings. As used herein, "system" and "assembly" are used interchangeably. It should be noted that the articles "a", "an", and "the", as used in this specification, include plural referents unless the content clearly dictates otherwise. Additional features and functions are illustrated and discussed below.

Figure 2:
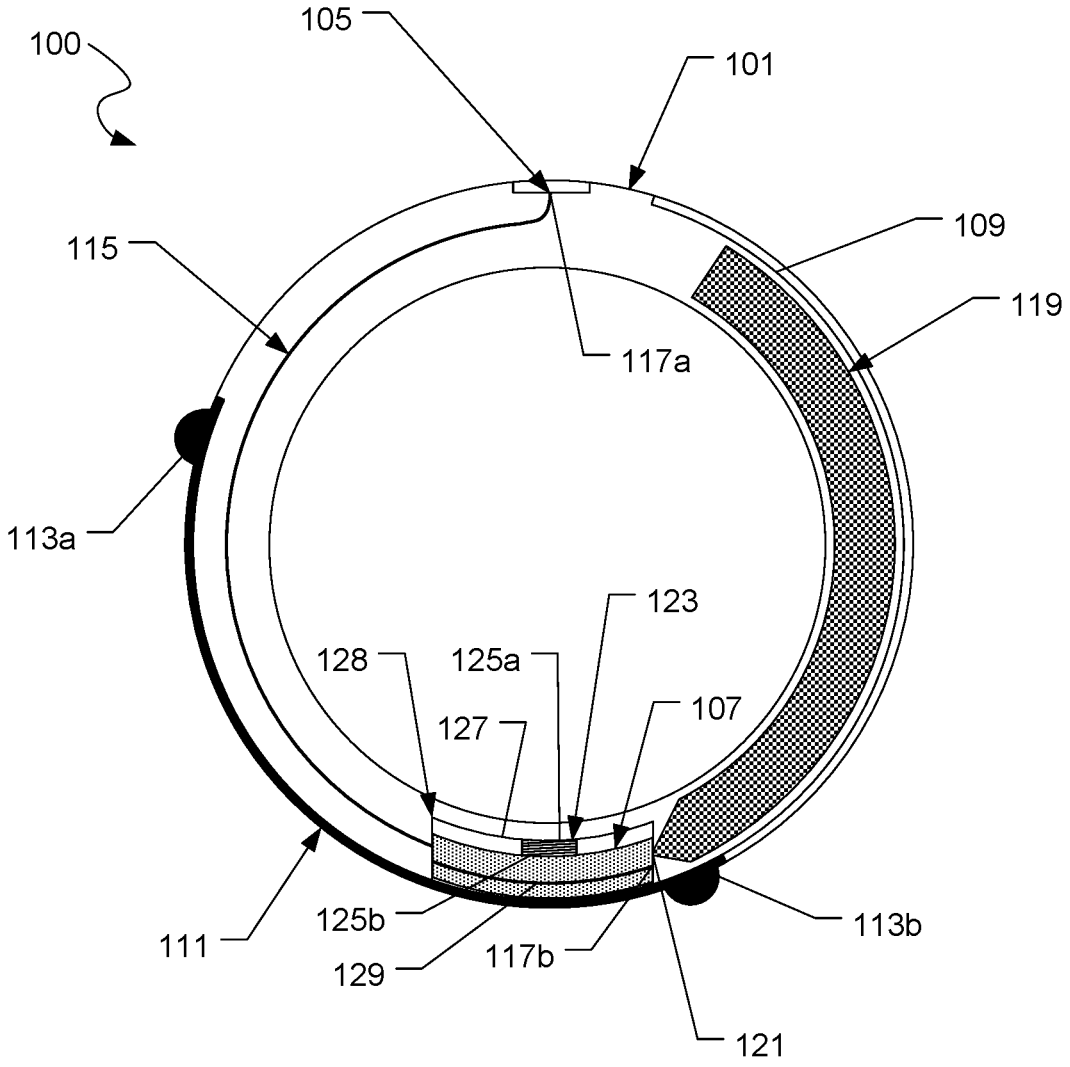
FIG. 2 is a cross sectional view of the ring assembly of FIG. 1 with a safety cover engaged.
Figure 3:
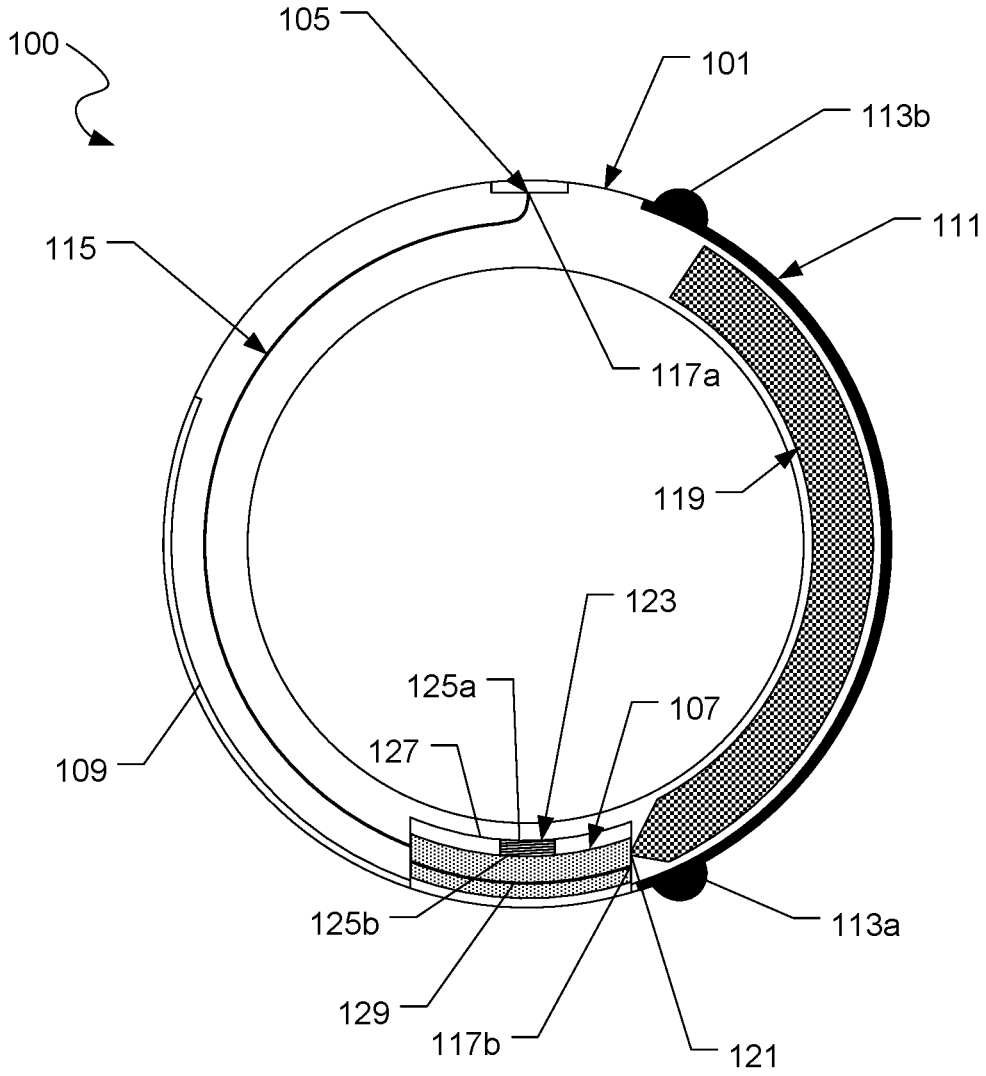
FIG. 3 is a cross sectional view of the ring assembly of FIG. 1 with a safety cover disengaged.
Figure 4:
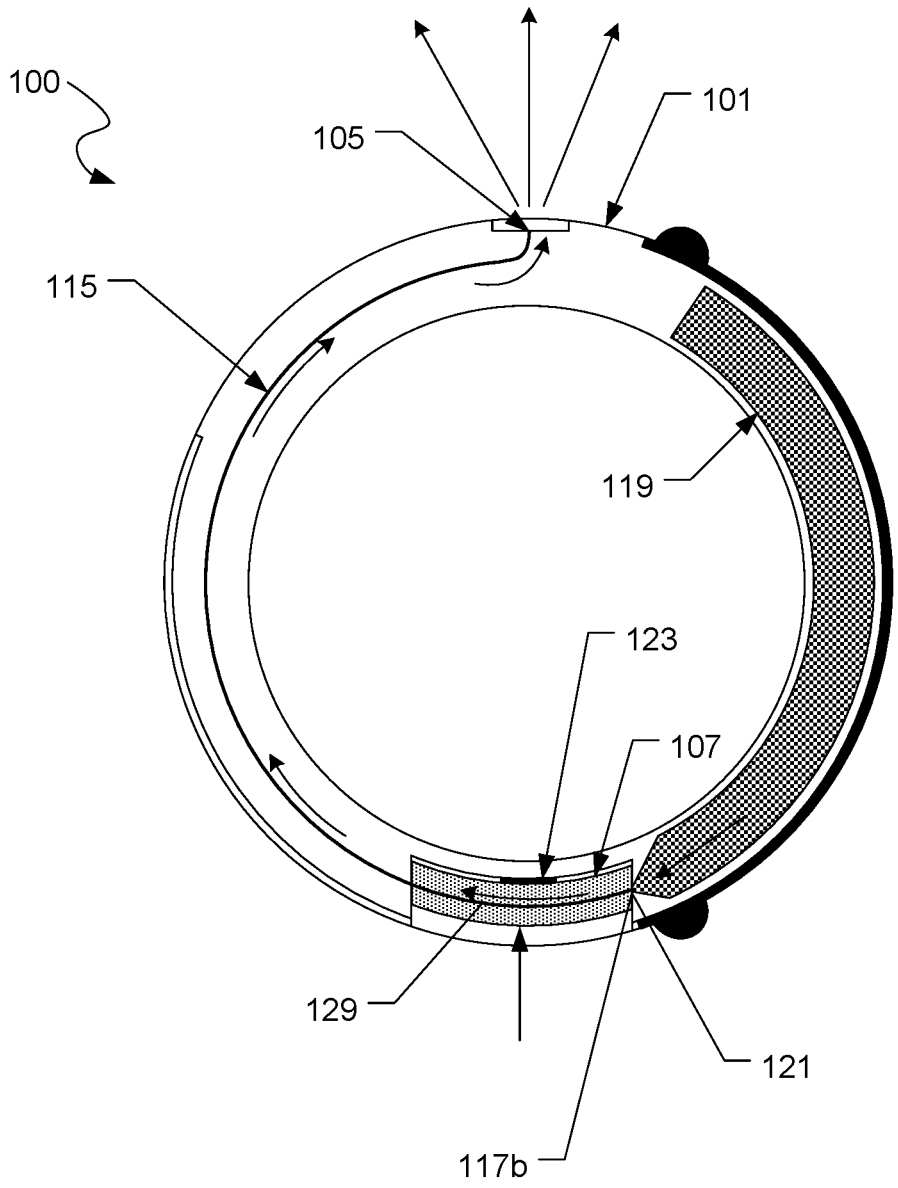
FIG. 4 is a cross sectional view of the ring assembly of FIG. 1 with a safety cover disengaged and a button depressed to release a pressurized repellant.

Referring now to the drawings wherein like reference characters identify corresponding or similar elements in form and function throughout the several views. FIG. 1 illustrate a perspective view of a self-defense ring assembly as well as illustrating a cover member that selectively exposes an activation button. FIG. 2-4 illustrates cross sections of the ring assembly illustrating an engaged and disengaged position of the cover member and activation of the button to release a pressurized repellant.

Referring now to FIG. 1, a perspective view of ring assembly 100 is illustrated in accordance with an embodiment of the present invention.

In FIG. 1, ring assembly 100 is a self-defense ring wearable on a finger of a user. In this figure, ring assembly 100 includes, but is not limited to, ring body 101, track 109, cover member 111, nozzle 105, and button 107. Internal components of ring assembly 100 are further detailed and illustrated with respect to FIGS. 2-4. Various proportions of the components of ring assembly 100 are considered to accommodate various finger sizes. Nozzle 105 (obscured from view in FIG. 1) is an exit orifice for a pressurized repellant when button 107 is activated to release the pressurized repellant from a chamber within ring assembly 100. Nozzle 105 may have various configurations to accommodate various ejection angles from ring assembly 100 as well as various spray cone angles (e.g., a directed stream or a cone trajectory). In this figure, nozzle 105 is located on surface 103 of ring body 101.

Located on surface 103 of ring body 101 is track 109 that runs along ring body 101. In this figure, track 109 runs circumferentially along ring body 101. Track 109 restricts cover member 111 to translate along track 109. Various configurations for track 109 to restrict cover member 111 to translate along track 109 are contemplated. For example, the configuration between 109 and cover member 111 can be a tongue and groove configuration. Cover member 111 is a safety mechanism that selectively translates along track 109 such that cover member 111 selectively exposes button 107. While cover member 111 is in an engaged position, cover member 111 covers button 107 to prevent accidental activation of button 107. To activate ring assembly 100 from the engaged position, the user translates cover member 111 along track 109 from the engaged position to a disengaged position, wherein the disengaged position exposes button 107. While in the disengaged position, the user may depress button 107 to activate ring assembly 100 to eject a pressurized repellant.

In this figure, button 107 and nozzle 105 are located proximately at opposing ends of ring body 101 from each other. In wearing ring assembly 100, the user positions ring assembly 100 on a finger of the user such that nozzle 105 is proximate to a posterior side of a hand having the finger. By positioning nozzle 105 proximate to the posterior side of the hand, button 107 is subsequently positioned proximate to an anterior side (i.e., palm side) of the hand. This orientation permits the user to translate cover 111 and depress button 107 using a thumb of the hand. Ring assembly 101 may have one or more knobs located on cover 111 to serve as a grip for the thumb of the user in translating cover 111. In this figure, the user may use knob 113 to translate cover 111 along track 109.

Referring now to FIG. 2, a cross sectional view of ring assembly 100 with cover 111 in an engaged position is illustrated in accordance with the embodiment of the present invention.

In this figure, ring assembly 100 includes the components previously mentioned in FIG. 1 as well as, but not limited to, chamber 119, conduit 115, and spring 123. In this figure, ring assembly 100 has chamber 119 within ring body 101, wherein chamber 119 contains a pressurized repellant. In this figure, chamber 119 has opening 121. In this figure, cover member 111 covers button 107 to prevent button 107 from accidental depression.

In this figure, ring assembly 100 has conduit 115 within ring body 101. Conduit 115 is a passage that permits pressurized repellant to pass through ring body 101 from opening 121 of chamber 119 to nozzle 105 when button 107 is depressed. Conduit 115 has a first end (i.e., end 117*a*) and a second end (i.e., end 117*b*). In this figure, nozzle 105 is in communication with end 117*a* of conduit 115.

In this figure, a portion of conduit 115 passes through button 107 (i.e., portion 129), and subsequently selectively translates along with button 107. While button 107 is not activated, portion 129 is in a disconnected position from conduit 115 that makes the passage of conduit 115 running between opening 121 of chamber 119 to nozzle 105 discontinuous, thereby preventing the pressurized repellant from passing through conduit 115. In this figure, button 107 forms a barrier that blocks the pressurized repellant from passing through conduit 115. Gaskets and/or O-rings may further be employed between button 107 and conduit 115 to maintain the barrier. In this figure, portion 129, as part of button 107, includes end 117*b* of conduit 115, wherein end 117*b* is in selective communication with opening 121 of chamber 119 corresponding to selective translation of button 107. However, it should be appreciated that portion 129 located within button 107 may contain any portion along conduit 115 which may or may not include ends 117*a* and 117*b* of conduit 115. For example, ends 117*a* and 117*b* may be configured to be in permanent communication with nozzle 105 and opening 121 respectively, while portion 129 passing through button 107 contains any portion of conduit 115 located between ends 117*a* and 117*b*.

Ring assembly 100 has button 107 spring biased to maintain portion 129 of conduit 115 in a disconnected position from the conduit, wherein the disconnected position of portion 129 maintains pressure for the pressurized repellant in chamber 119. Compression of button 107 against the spring bias connects portion 129 with conduit 115, thereby permitting the pressurized repellant to be ejected through conduit 115. In this figure, spring 123 provides the spring bias for button 107. Spring 123 has ends 125 and 125*b*, wherein end 125*a* is in communication with cavity surface 127 of cavity 128 and end 125*b* is in communication with button 107. Cavity 128 is a cavity within ring body 101 that permits button 107 to selectively translate within ring body 101. Button 107 is located internally with ring body 101 and selectively exposed by cover 111.

In this figure, knobs 113*a* and 113*b* on cover 111 are of similar form and function as knob 113.

Referring now to FIG. 3, a cross sectional view of ring assembly 100 with cover 111 in a disengaged position is illustrated in accordance with the embodiment of the present invention.

In this figure, the user translates cover 111 along track 109, thereby exposing button 107.

Referring now to FIG. 4, a cross sectional view of ring assembly 100 with cover 111 in a disengaged position and button 107 depressed to release a pressurized repellant is illustrated in accordance with the embodiment of the present invention.

In this figure, button 107 is depressed, thereby making conduit 115 between nozzle 105 and opening 121 of chamber 121 continuous, thus permitting the pressurized repellant to pass through conduit 115 and eject from nozzle 105. In this figure, button 107 is compressed against spring 123, thus portion 129 is becomes continuous with conduit 115 and end 117*b* is translated into communication with opening 121.

As a method of using ring assembly 101, a user wearing a ring assembly 101 on a finger of a hand translates cover 111 along track 109 of ring body 101 using a thumb corresponding with the hand having the finger, thereby selectively exposing button 107. The user then positions the thumb between ring assembly 101 and a palm associated with the hand of the user, thereby forming a fist. The user then directs nozzle 105 towards a direction associated with an assailant. Lastly, the user depresses button 105 with the thumb, thereby releasing the pressurized repellant from chamber 119, subsequently resulting in the pressurized repellant ejecting from nozzle 105 towards the direction associated with the assailant.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A self-defense ring assembly, comprising:

a ring body;

a chamber within the ring body containing a pressurized repellant, the chamber having an opening;

a conduit within the ring body, the conduit having a first end and a second end, the first end in communication with the opening;

a nozzle located on a surface of the ring body, the nozzle in communication with the second end of the conduit; and a button located on the ring, the button having a portion of the conduit passing through the button, the button selectively translating the portion of the conduit, the button is spring biased to maintain the portion of the conduit in a disconnected position from the conduit, wherein the button acts to form a barrier to prevent discharge of the pressurized repellant prior to depressing it.

2. The assembly of claim 1, further comprising:

a track running along the ring body; and a cover member that selectively translates along the track, the cover member selectively exposing the button.

3. The assembly of claim 2, the cover member further comprising one or more knobs.

4. The assembly of claim 1, wherein the disconnected position of the portion of the conduit maintains pressure for the pressurized repellant in the chamber.

5. The assembly of claim 1, wherein compression of the button against the spring bias connects the portion of the conduit with the conduit, thereby permitting the pressurized repellant to be ejected through the conduit.

6. The assembly of claim 1, wherein the button and the nozzle are located at opposing distal ends from each other on the ring body.

7. A self-defense ring assembly, comprising:

a ring body;

a chamber within the ring body containing a pressurized repellant, the chamber having an opening;

a conduit within the ring body, the conduit having a first end and a second end, the first end in communication with the opening;

a nozzle located on a surface of the ring body, the nozzle in communication with the second end of the conduit;

a button located on the ring body, the button selectively translating a barrier in communication with the conduit;

a track running along the ring body; and a cover member that selectively translates along the track, the cover member selectively exposing the button.

8. The assembly of claim 7, the cover member further comprising one or more knobs.

9. The assembly of claim 7, wherein the button is spring biased to maintain the barrier in communication with the conduit, thereby blocking a passage of the conduit and maintaining pressure for the pressurized replant in the chamber.

10. The assembly of claim 9, wherein compression of the spring biased button translates the barrier away from the conduit, thereby opening the passage of the conduit and permitting the pressurized repellant to be ejected through the conduit.

11. A method of using a self-defense ring assembly worn by a digit of a user, the method comprising:

positioning a thumb of the user between the ring and a palm of the user;

directing a nozzle of the ring assembly towards a direction associated with an assailant;

translating a cover along a track of the ring to expose a concealed button within the ring;

depressing the button located on the ring with the thumb of the user; and releasing a pressurized repellant from a chamber, the pressurized repellant ejecting from the nozzle towards the direction associated with an assailant.

12. The method of claim 11, wherein the button is located internally within the ring.

13. The method of claim 11, wherein the button and the nozzle are located at opposing distal ends from each other on the ring body.

14. The method of claim 12, wherein the pressurized repellant passes through the button prior to discharging from the nozzle.

* * * * *